United States Patent [19]

Wilson

[11] Patent Number: 5,003,908

[45] Date of Patent: Apr. 2, 1991

[54] CONTROL AND LIMITING OF OIL SPILLS FROM AN OCEAN GOING TANKER

[76] Inventor: Robert A. Wilson, 10 Hillside Pl., Cranford, N.J. 07016

[21] Appl. No.: 339,202

[22] Filed: Apr. 17, 1989

[51] Int. Cl.[5] ..... B63B 43/16

[52] U.S. Cl. ..... 114/229

[58] Field of Search ..... 114/227, 228, 229, 74 R

[56] References Cited

U.S. PATENT DOCUMENTS

| | | | |
|---|---|---|---|
| 496,598 | 5/1893 | Cinamon | 114/229 X |
| 569,430 | 10/1896 | Schroeder | 114/229 |
| 991,507 | 5/1911 | Hitchfield | 114/74 R |
| 1,099,167 | 6/1914 | Czerniawski | 114/229 |
| 1,511,155 | 10/1924 | Blumberg | 114/229 |
| 3,183,876 | 5/1965 | Kronhaus | 114/229 |

FOREIGN PATENT DOCUMENTS

| | | | |
|---|---|---|---|
| 35084 | 3/1977 | Japan | 114/74 R |

*Primary Examiner*—Sherman Basinger

[57] ABSTRACT

The instant invention is best described as an emergency tank leakage control device for an ocean going tanker damaged (holed) tank. The proposed installed shipboard rolled curtains, haulage winches, cables, and controls must be manually operated by the ship's crew when needed to control leakage from a ruptured tank. Equipment is not shown or proposed to automatically deploy leakage control curtains however automatic operation is considered feasible.

1 Claim, 1 Drawing Sheet

CONTROL AND LIMITING OF OIL SPILLS FROM AN OCEAN GOING TANKER

BACKGROUND OF THE INVENTION

The proposed arrangement of equipment to be installed on a conventional oil tanker will limit the outflow of the carried oil from a damaged oil tank.

The installed equipment consisting of a heavy rolled cable reinforced rubberized sheeting curtain would be drawn over the holed tank or tanks by deck-located cables and tightly secured by winches. This action would be accomplished manually and by power winches. This action would be taken when an accident occurred. It is possible that the deployment of the oil limiting curtains could be automatic. Since the oil tank pressure and the adjacent sea water pressure is essentially equal after tank rupture had occurred, oil flow from the tank with a curtain firmly in place would be kept at a minimum. As can be seen in the attached drawing, a rolled enclosed curtain could be located along the ship keel for an "upward draw." An alternate location for the rolled curtain could be at deck level for a "downward draw" by control cables coming up to the deck on the ship center line. Rupture leakage control curtains are required for each of the ship tanks for control of tank leakage.

FIELD OF INVENTION

Modern day world wide shipping of crude oil and other products by ocean going tankers has on occasion met with accidents causing oil spillage. These accidents have caused peril to wild life and degradation of shore line property. The proposed system of strategically located heavy curtains built into a tanker ship would limit oil/product flow from a ruptured ship tank (s). The rolled curtains would be stored for emergency use in covered recesses on the ship at keel level or at deck level. If an accident should occur which involved the rupture and subsequent spillage of oil/products from one or more of the tanks, the appropriate curtain would be hauled by a winch out of the compartment upward or downward over the hole. Since tank pressure and sea water pressure are equal at the rupture location, a tightly pulled curtain covering the rupture opening would prevent major outflow of tankage oil/products. The deployment of the proposed emergency leakage control equipment would not effect, displace or substitute for other ship board emergency equipment and procedure.

BRIEF SUMMARY OF INVENTION

The instant invention proposes equipment to be installed on board a tanker vessel to limit the outflow of oil/product from an accident which ruptures a tank or tanks on the tanker. The control is accomplished by drawing a heavy, cable reinforced, rolled curtain by a suitable haulage cable over the damaged tank (s). No other shipboard emergency system would be affected by the activation of the leakage control curtains.

BRIEF DESCRIPTION OF THE DRAWINGS

The invention may be better understood by reference to the accompanying drawing FIGS. 1 and 2. The drawings show two sections through a conventional tanker. The upper section (FIG. 1) shows the leakage control curtain 5,6 located at the keel level of the ship so as to permit the control curtain to be drawn upward to cover a tank rupture in the ship's side (tank side). The lower section (FIG. 2) shows the leakage control curtain located at the deck level so as to permit the control curtain to be drawn downward to cover a tank rupture.

DETAILED DESCRIPTION OF THE DRAWINGS

Figure 1:
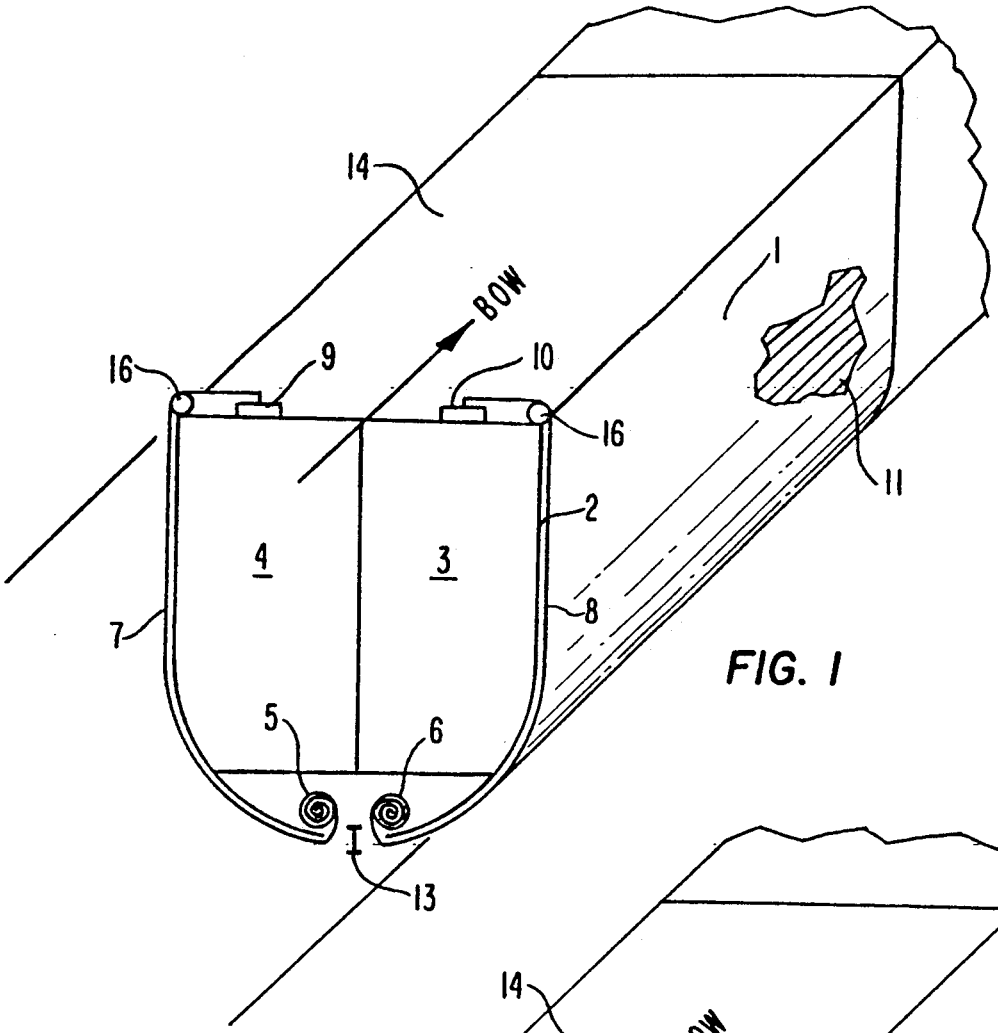
Figure 2:
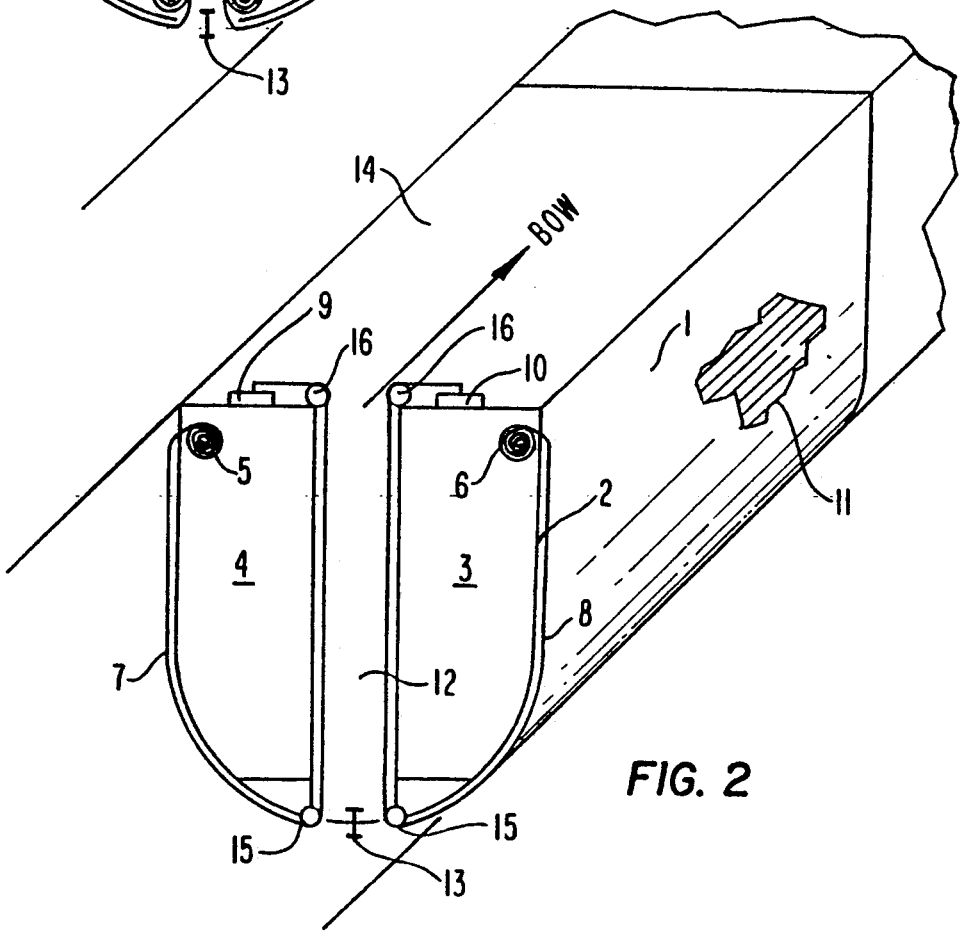

FIGS. 1 and 2 show possible leakage control curtains locations. A portion of the ship's hull (1 and 2) normally contains numerous tanks only two of which are shown at 3 and 4. The coiled control curtains 5,6 are shown in FIG. 1 at keel level and in FIG. 2 at deck level. Duplicate locations may be preferred by an owner or designer. The curtains would be contained in covered compartments on the port and starboard sides of the ship so as to not create water or air turbulence. Shown at points 7,8 are operating cables connected to pulling winches 9, 10 to deploy the leakage control curtains when necessary. Item 11 shows a possible location of tank damage. A leak could however be at any place in the tank side from the keel to the deck and still be covered by the proposed curtain.

We claim is:

1. An apparatus for limiting the leakage of liquid product form a leak in a tank of a tanker vessel, said tanker vessel having a deck, a keel, a starboard side, and a port side, said apparatus comprising:

a first winch and a second winch, said first winch and said second winch being located on said deck, said first winch being further located adjacent said starboard side, and said second winch being further located adjacent said port side;

a first rolled curtion and a second rolled curtain, said first rolled curtain being located in a first recessed covered compartment on said starboard side above said tank at said deck, said second rolled curtain being located in a second recessed covered compartment on said port side above said tank at said deck;

a pair of cables, one of said cables connecting said first winch and said first rolled curtain, the other of said cables connecting said second winch and said second rolled curtain;

an opening in said tanker vessel extending from substantially said keel to substantially said deck;

two pair of cable guides, one pair being located adjacent said keel and said opening at said keel, the other pair of said cable guides being located adjacent said deck and said opening at said deck;

said one cable extending form said first rolled curtain along said starboard side to one of said cable guides at said keel, upwardly through said opening to one of said cable guides at said deck, and to said first winch;

said other cable extending from said second rolled curtain along said port side to another of said cable guides at said keel, upwardly through said opening to another of said cable guides at said deck, and to said second winch;

whereby said winches can be used with said cables to unroll downwardly on the sides of said tanker vessel said rolled curtains so as to cover said leak.

* * * * *